US011585155B2

(12) United States Patent
Nguyen

(10) Patent No.: US 11,585,155 B2
(45) Date of Patent: Feb. 21, 2023

(54) MILL, DOWNHOLE TOOL WITH MILL, METHOD AND SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/339,077

(22) Filed: Jun. 4, 2021

(65) Prior Publication Data

US 2022/0389762 A1 Dec. 8, 2022

(51) Int. Cl.

| | |
|---|---|
| ***E21B 23/04*** | (2006.01) |
| ***E21B 29/06*** | (2006.01) |
| ***E21B 34/10*** | (2006.01) |
| ***E21B 7/06*** | (2006.01) |
| ***E21B 17/18*** | (2006.01) |
| ***E21B 34/06*** | (2006.01) |

(52) U.S. Cl.

CPC ..... *E21B 7/061* (2013.01); *E21B 17/18* (2013.01); *E21B 23/042* (2020.05); *E21B 29/06* (2013.01); *E21B 34/063* (2013.01); *E21B 34/103* (2013.01)

(58) Field of Classification Search

CPC ..... E21B 7/061; E21B 23/042; E21B 29/06; E21B 34/103

See application file for complete search history.

(56) References Cited

U.S. PATENT DOCUMENTS

| | | | | |
|---|---|---|---|---|
| 5,529,126 | A * | 6/1996 | Edwards | E21B 23/006 166/240 |
| 5,720,349 | A * | 2/1998 | Pleasants | E21B 34/101 166/55.7 |
| 5,743,331 | A * | 4/1998 | Adkins | E21B 23/04 166/334.4 |
| 6,050,334 | A * | 4/2000 | McGarian | E21B 23/01 166/117.6 |
| 6,334,487 | B1 * | 1/2002 | Adkins | E21B 34/10 166/334.4 |
| 7,077,212 | B2 | 7/2006 | Roesner et al. | |
| 8,739,900 | B2 * | 6/2014 | Gregurek | E21B 7/067 175/45 |
| 10,227,823 | B2 * | 3/2019 | Hern | E21B 7/067 |
| 11,142,996 | B2 * | 10/2021 | Ali | E21B 34/10 |
| 11,333,004 | B2 * | 5/2022 | Taylor, Jr. | E21B 34/14 |
| 2010/0044056 | A1 * | 2/2010 | Howell | E21B 23/04 166/381 |

(Continued)

OTHER PUBLICATIONS

Notification of Transmittal of the International Search Report and the Written Opinion of the International Searching Authority, or the Declaration; PCT/US2022/031924; dated Sep. 23, 2022; 10 pages.

*Primary Examiner* — Jennifer H Gay

(74) *Attorney, Agent, or Firm* — Cantor Colburn LLP

(57) ABSTRACT

A mill including a housing having a fluid bypass pathway, a milling feature at a longitudinal end of the housing, a chamber defined by the housing, and a piston disposed in communication with the chamber, the piston defining a fluid passageway initially aligned with the fluid bypass pathway, the piston responsive to pump pressure to move toward the milling feature, the movement misaligning the fluid passageway with the fluid bypass pathway.

17 Claims, 5 Drawing Sheets

(56) References Cited

U.S. PATENT DOCUMENTS

| | | | | |
|---|---|---|---|---|
| 2016/0168950 | A1* | 6/2016 | Delgado | E21B 34/103 166/321 |
| 2016/0348456 | A1* | 12/2016 | LaPlante | E21B 34/06 |
| 2017/0044866 | A1 | 2/2017 | Bulloch et al. | |
| 2018/0320448 | A1* | 11/2018 | Hern | E21B 7/061 |
| 2019/0136653 | A1 | 5/2019 | Hern et al. | |
| 2020/0011134 | A1* | 1/2020 | Nevlud | E21B 10/28 |
| 2020/0087987 | A1* | 3/2020 | Campbell | E21B 33/134 |
| 2020/0115997 | A1 | 4/2020 | Stang et al. | |
| 2020/0291748 | A1* | 9/2020 | Ali | E21B 29/06 |
| 2021/0381339 | A1* | 12/2021 | Taylor, Jr. | E21B 34/063 |

* cited by examiner

MILL, DOWNHOLE TOOL WITH MILL, METHOD AND SYSTEM

BACKGROUND

In the resource recovery and fluid sequestration industries, it is often necessary to created a lateral borehole from a preexisting borehole. Downhole tools that include a mill and whipstock are known for this function but they suffer from a requirement for valves in a drill string that require significant quantities of clean fluid be provided at a rig site. Alternatively, prior art arrangements suffer from contaminated fluid fouling passageways needed for setting anchors and packers associated with the whipstock. Drawbacks such as these cause delays and cost overruns that are better avoided.

SUMMARY

An embodiment of a mill including a housing having a fluid bypass pathway, a milling feature at a longitudinal end of the housing, a chamber defined by the housing, and a piston disposed in communication with the chamber, the piston defining a fluid passageway initially aligned with the fluid bypass pathway, the piston responsive to pump pressure to move toward the milling feature, the movement misaligning the fluid passageway with the fluid bypass pathway.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
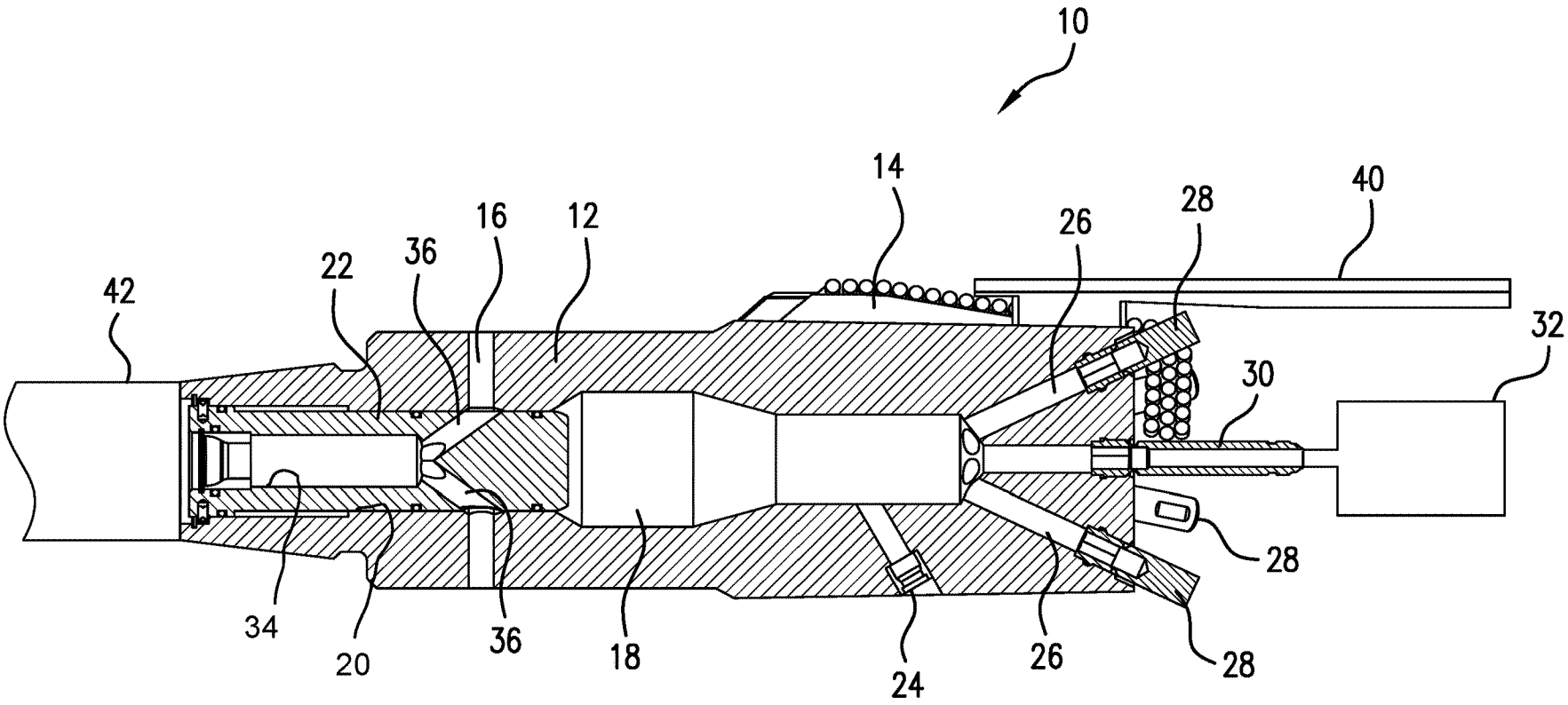
FIG. 1 is a sectional view of a mill as disclosed herein in a first position.

Referring to FIG. 1, a mill 10 is illustrated in a first position ready to run into the hole or in the act of being run into the hole. The mill 10 comprises a housing 12 having a milling feature 14 at an outside surface thereof. The housing defines a bypass flow path 16 and a chamber 18. Further, the housing defines a bore 20 that is receptive to a piston 22 slidably receivable therein. The chamber 18 is fluidly connected to a rupture member 24, drilling fluid outflow paths 26 that are capped with break-off caps 28 and a control line 30. The control line 30 fluidly connects the chamber 18 to an anchor or packer 32. Accordingly, chamber 18 presents a sealed volume where clean fluid such as water or hydraulic fluid may be disposed to be used for actuation of the anchor or packer 32, at a desired time. The clean fluid may be disposed in the chamber 18 at a rig site or at a manufacturing site but it should be noted that since the volume of chamber 18 is relatively small, much less fluid must be made available on a rig site if that is to be where the chamber 18 is filled than would be the case if a traditional valve were used to manage the mill and whipstock (in the range of about 4:1 to about 20:1 reduction of fluid). As will be recognized, the prior art fluid would need to fill some 90 feet of drill pipe, presenting a much greater volume.

Figure 2:
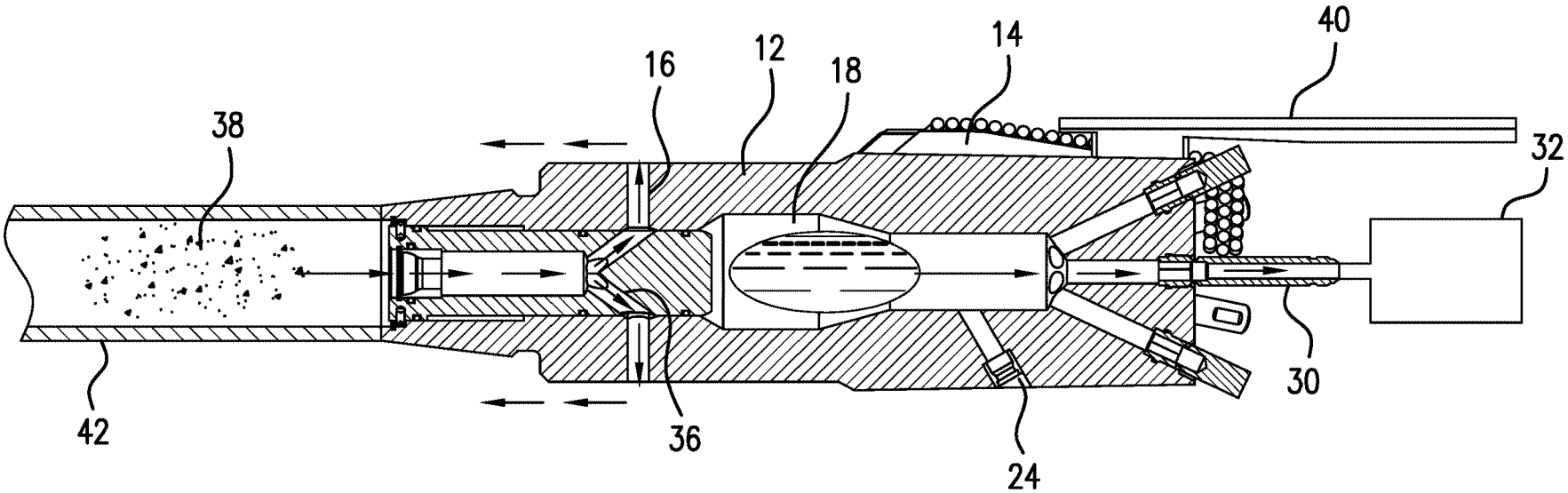
FIG. 2 is the mill in the same position as FIG. 1 but illustrating initial mud circulation through the mill.

Piston 22 defines a bore 34 that is open to wellbore fluid and ports that fluid to the bypass flow path 16 by fluid passageways 36. Circulation fluid or drilling mud 38 hence has an initial pathway as illustrated in FIG. 2. The mill is static in this condition and can be run in hole this way until the orientation and depth are established by MWD or similar art recognized method. The chamber 18 remains sealed against debris or "dirty" fluid while the circulation occurs through flow path 16 and passageways 36. Once the mill 10 and the associated whipstock 40 are positioned and orientated properly, pressure through a string 42, upon which the entire downhole tool 48 (including the mill 10 and whipstock 40) is hung, may be increased for the purpose of setting the anchor/packer 32.

Figure 3:
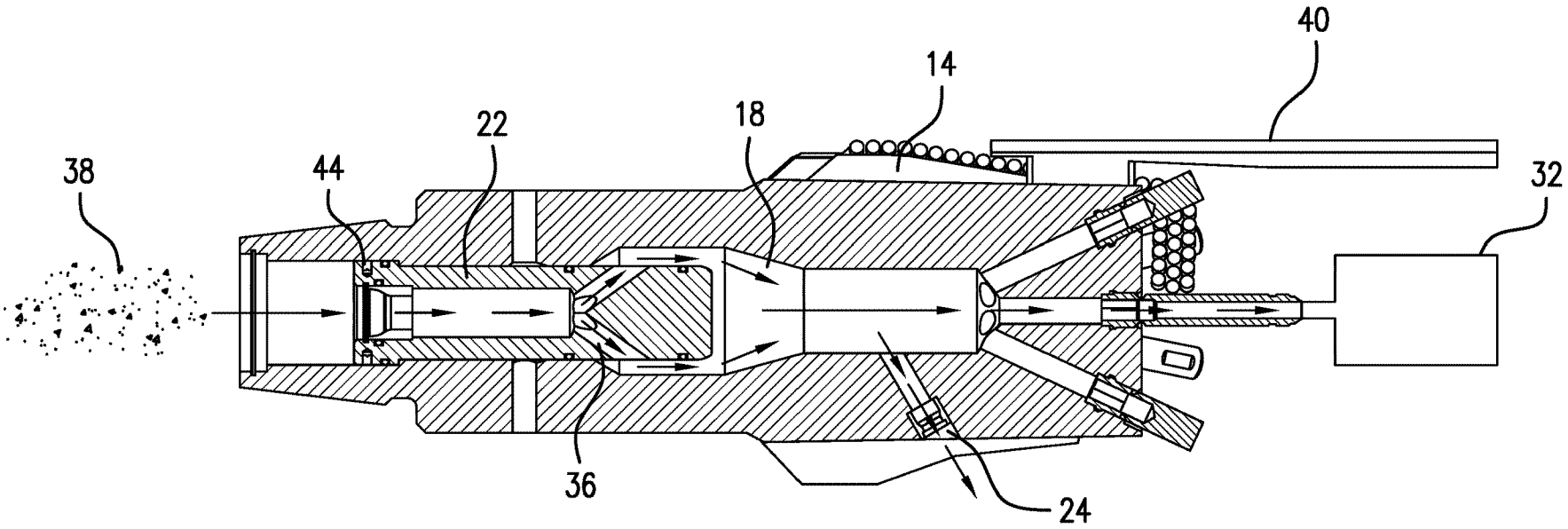
FIG. 3 is the mill of FIG. 1 in a second position.

Referring to FIG. 3, the piston 22 is illustrated moved within housing 12. This occurs after a release member 44 such as a shear screw or similar is released due to pressure applied to the piston 22. The sudden release of member 44 will provide a telltale pressure signal at surface. Fluid in the chamber 18, which as noted above is clean, is pressurized by the movement of the piston 22 and begins the setting process of anchor/packer 32. Further pressure from surface is applied to the chamber once the passageway 36 is aligned with the chamber 18 thereby allowing all pressure from the string 42 to access chamber 18. Since the clean fluid is first to "see" the control line 30 however, any contamination of debris in the drilling mud 38 is unlikely to create any obstruction to the control line 30.

Figure 4:
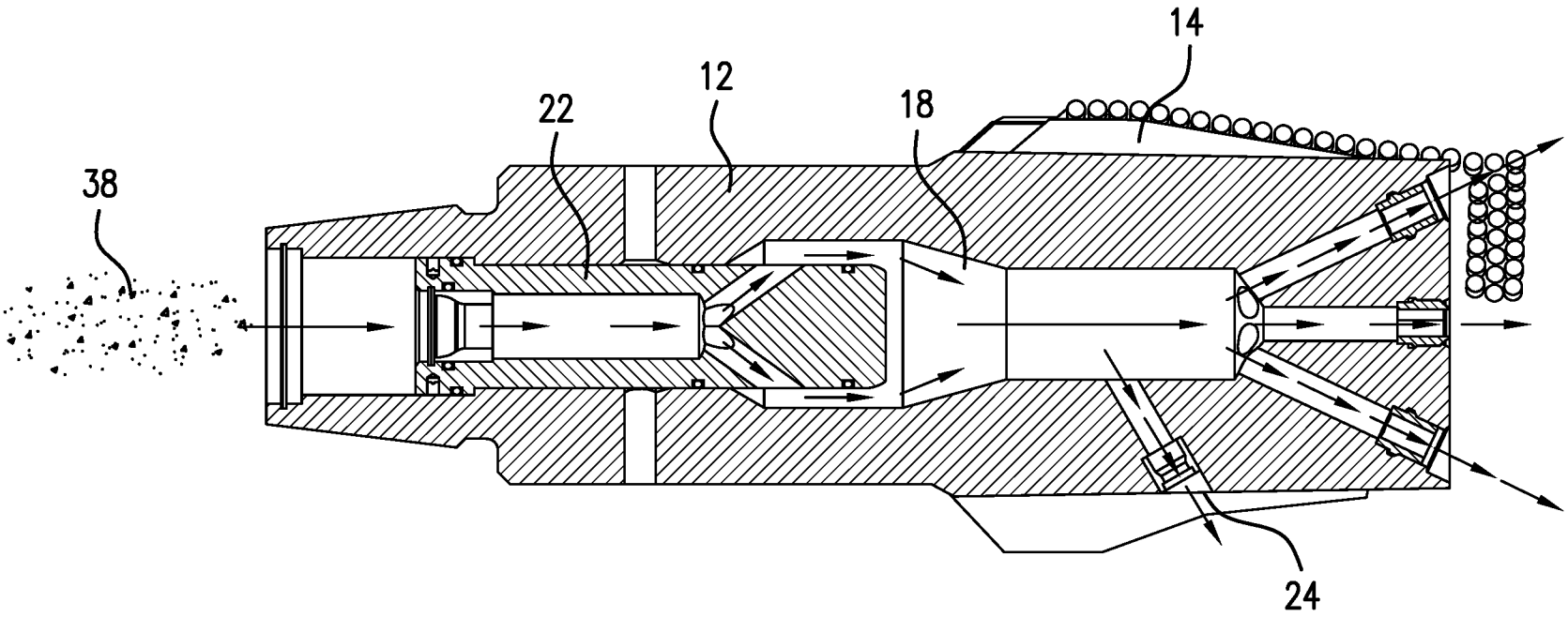
FIG. 4 is the mill of FIG. 1 in a third position.

After reaching the setting pressure, and therefore presumably setting the anchor/packer, the rupture member 24 will rupture. This prevents overpressure from causing the rig blow off valve popping and shutting down activity. Circulation will be reinitiated through the rupture member 24 after rupture. Assuming the anchor/packer 32 is set, set down weight will free the whipstock 40 from the mill 10. Rotation of string 42, breaks off the caps 28 and the control line 30 allowing drilling fluid to flow out of the face of the milling feature 14 (see FIG. 4) thereby allowing milling to begin. The mill 10 will then proceed in a manner similar to the prior art in following the whipstock and milling the casing exit.

Beneficial features of the mill 10 as disclosed herein include that there is no need to shut down pumps during the process as is the case in the prior art; clean fluid in the chamber ensures no contamination of the anchor/packer 32; the control line 30 is at the front face of the housing 12 rather than at a rear end of the housing like in the prior art which tends to protect the control line 32 far better than it being exposed along a side of the housings of the prior art; and finally, the mill as disclosed mitigates against early deployment due to the rupture member 24. Because the member will rupture in the event of a transient pressure event that is not intended, it may be that the tool 48 as disclosed herein is still viable. This will be signaled to surface in a pressure change due to fluid circulating through the rupture member 24 rather than through the passageways 36. If the string 42 can be raised to prove that early setting of the anchor/packer did not actually occur, the running may continue. In the prior art, this is not a possibility and the whole downhole tool must be retrieved and reset/reworked.

Figure 5:
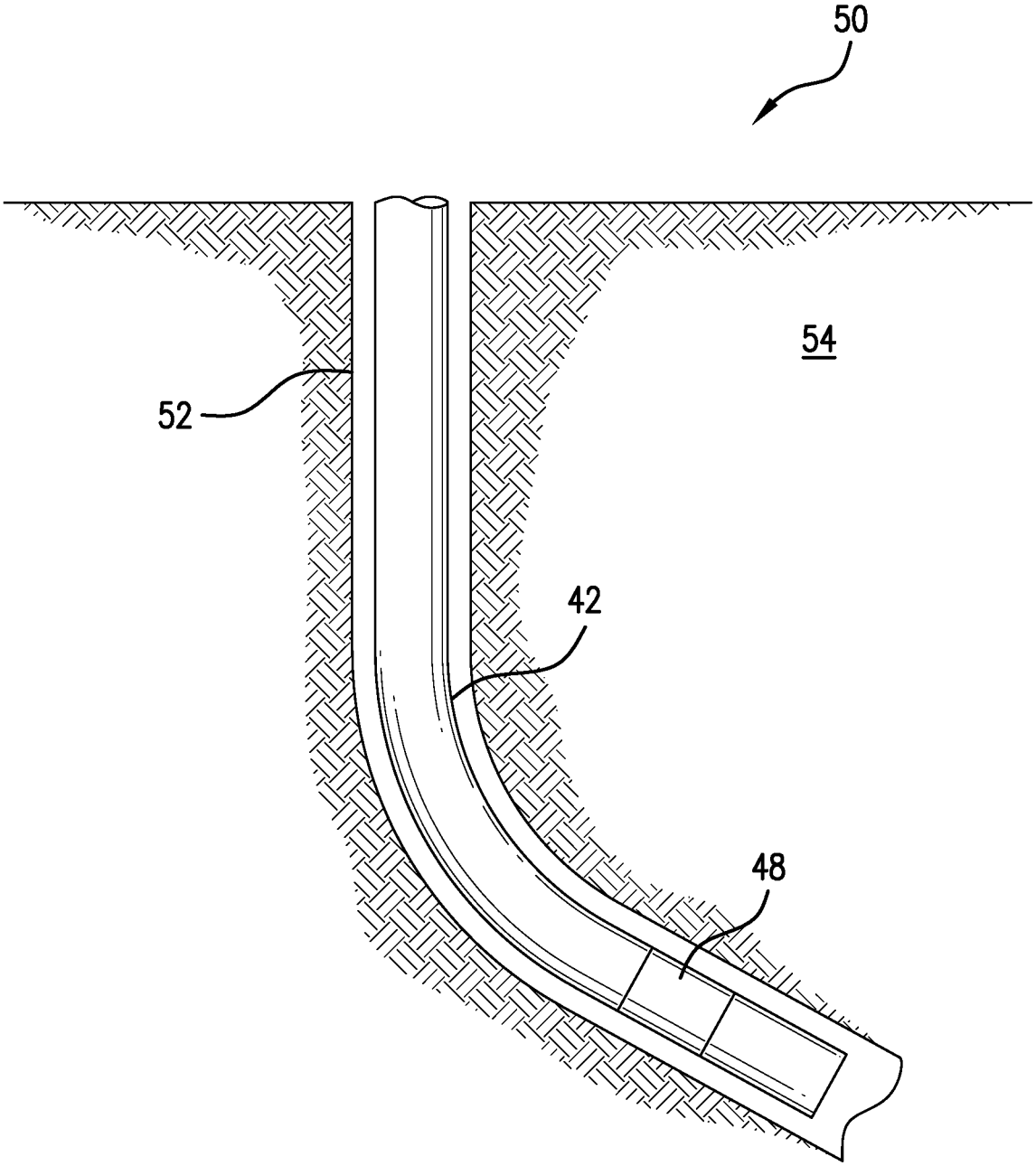
FIG. 5 is a view of a wellbore system including the mill disclosed herein.

Referring to FIG. 5, a wellbore system 50 is illustrated. The system 50 comprises a borehole 52 in a subsurface formation 54. A string 42 is disposed in the borehole 52. A tool 48 is disposed within or as a part of the string 42.

Set forth below are some embodiments of the foregoing disclosure:

Embodiment 1: A mill including a housing having a fluid bypass pathway, a milling feature at a longitudinal end of the housing, a chamber defined by the housing, and a piston disposed in communication with the chamber, the piston defining a fluid passageway initially aligned with the fluid bypass pathway, the piston responsive to pump pressure to move toward the milling feature, the movement misaligning the fluid passageway with the fluid bypass pathway.

Embodiment 2: The mill as in any prior embodiment, wherein the housing further includes a rupture member.

Embodiment 3: The mill as in any prior embodiment, wherein the piston is maintained in the initial position by a release member.

Embodiment 4: The mill as in any prior embodiment, wherein the release member is a shear member.

Embodiment 5: The mill as in any prior embodiment, wherein the chamber is receptive to and retentive of clean fluid in the initial position.

Embodiment 6: The mill as in any prior embodiment, wherein the chamber is fluidically connected to a tool to be set via a control line connected between the chamber and the tool to be set.

Embodiment 7: The mill as in any prior embodiment, wherein the fluidic connection is located at a mill face of the mill.

Embodiment 8: The mill as in any prior embodiment, wherein the tool is an anchor or packer.

Embodiment 9: The mill as in any prior embodiment, wherein the passageway after movement of the piston allows well fluid flow into the chamber.

Embodiment 10: The mill as in any prior embodiment, wherein the chamber is connected to mill face fluid outflow paths that are initially closed with break-off caps.

Embodiment 11: A downhole tool including a mill and a whipstock initially connected to the mill.

Embodiment 12: A method of forming a casing exit including flowing drilling mud through the fluid passageway and the fluid bypass pathway of the mill, pressuring on the piston, releasing the piston to move in the mill, and forcing clean fluid in the chamber to set an anchor or packer connected thereto.

Embodiment 13: The method as in any prior embodiment, further comprising a rupture member.

Embodiment 14: The method as in any prior embodiment, further comprising receiving information at surface of the piston moving based upon pressure signal generated by the rupture of the rupture member.

Embodiment 15: The method as in any prior embodiment, further comprising disconnecting a whipstock initially connected to the mill.

Embodiment 16: The method as in any prior embodiment, further comprising rotating the mill causing breakage of break-off closures and milling the exit.

Embodiment 17: A wellbore system including a borehole in a subsurface formation, a string in the borehole, and a mill disposed within or as part of the string.

Embodiment 18: The wellbore as in any prior embodiment, further comprising a whipstock initially connected to the mill.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mill comprising:

a housing having a fluid bypass pathway;

a milling feature at a longitudinal end of the housing;

a chamber defined by the housing; and a piston disposed in communication with the chamber, the piston defining a fluid passageway initially aligned with the fluid bypass pathway, the chamber receptive to and retentive of clean fluid in the initial position, the piston responsive to pump pressure to move toward the milling feature, the movement misaligning the fluid passageway with the fluid bypass pathway.

2. The mill as claimed in claim 1, wherein the housing further includes a rupture member.

3. The mill as claimed in claim 1, wherein the piston is maintained in the initial position by a release member.

4. The mill as claimed in claim 3, wherein the release member is a shear member.

5. The mill as claimed in claim 1, wherein the chamber is fluidically connected to a tool to be set via a control line connected between the chamber and the tool to be set.

6. The mill as claimed in claim 5, wherein the fluidic connection is located at a mill face of the mill.

7. The mill as claimed in claim 5, wherein the tool is an anchor or packer.

8. The mill as claimed in claim 1, wherein the passageway after movement of the piston allows well fluid flow into the chamber.

9. The mill as claimed in claim 1, wherein the chamber is connected to mill face fluid outflow paths that are initially closed with break-off caps.

10. A downhole tool comprising:

a mill as claimed in claim 1; and a whipstock initially connected to the mill.

11. A method of forming a casing exit comprising:

flowing drilling mud through the fluid passageway and the fluid bypass pathway of the mill as claimed in claim 1;

pressuring on the piston;

releasing the piston to move in the mill; and forcing clean fluid in the chamber to set an anchor or packer connected thereto.

12. The method as claimed in claim 11 further comprising rupturing a rupture member.

13. The method as claimed in claim 12 further comprising receiving information at surface of the piston moving based upon pressure signal generated by the rupture of the rupture member.

14. The method as claimed in claim 12 further comprising rotating the mill causing breakage of break-off closures and milling the exit.

15. The method as claimed in claim 11 further comprising disconnecting a whipstock initially connected to the mill.

16. A wellbore system comprising:

a borehole in a subsurface formation;

a string in the borehole; and a mill as claimed in claim 1 disposed within or as a part of the string.

17. The wellbore as claimed in claim 16 further comprising a whipstock initially connected to the mill.

* * * * *